US008196367B2

(12) United States Patent
De Bray

(10) Patent No.: US 8,196,367 B2
(45) Date of Patent: Jun. 12, 2012

(54) SUPPORT BRACKET FOR ANCHORING OVERLAPPING CLADDING TILES TO A WALL STRUCTURE

(76) Inventor: Guy De Bray, Salaberry de Valleyfield (CA)

( * ) Notice: Subject to any disclaimer, the term of this patent is extended or adjusted under 35 U.S.C. 154(b) by 0 days.

(21) Appl. No.: 12/990,429

(22) PCT Filed: Sep. 19, 2008

(86) PCT No.: PCT/CA2008/001649

§ 371 (c)(1),
(2), (4) Date: Oct. 29, 2010

(87) PCT Pub. No.: WO2009/135288

PCT Pub. Date: Nov. 12, 2009

(65) Prior Publication Data

US 2011/0047926 A1 Mar. 3, 2011

(30) Foreign Application Priority Data

May 3, 2008 (GB) ..... 0808137.4

(51) Int. Cl.
*E04D 1/34* (2006.01)

(52) U.S. Cl. ..... 52/549; 52/489.2; 52/546; 52/547; 52/506.06

(58) Field of Classification Search ..... 52/235, 52/478, 489.1, 489.2, 506.05, 506.06, 506.08, 52/506.09, 543, 546, 549, 551, 553
See application file for complete search history.

(56) References Cited

U.S. PATENT DOCUMENTS 2,188,090 A * 1/1940 Young ..... 52/459
2,495,303 A * 1/1950 Wisniewski ..... 52/468
2,519,656 A * 8/1950 Howe ..... 52/547
2,914,148 A 11/1959 Bock
3,248,838 A 5/1966 Stark
3,276,797 A 10/1966 Humes, Jr
4,516,373 A 5/1985 Osawa
5,390,457 A 2/1995 Sjölander
(Continued)

FOREIGN PATENT DOCUMENTS

CA 2352381 A1 6/2000
JP 02115445 A 4/1990
JP 11200589 A 7/1999
JP 2007023571 A 2/2007

*Primary Examiner* — Brian Glessner
*Assistant Examiner* — Adriana Figueroa

(57) ABSTRACT

A support bracket (10) for anchoring cladding tiles (40) to a support wall structure (54), the support bracket (10) comprising: a substantially elongated base plate portion (12) attachable to the support wall structure (54), the base plate portion (12) defining a base first end edge (20) and a substantially opposed base second end edge (18), the base plate portion (12) also defining a base first side (22) and a substantially opposed base second side (24); and a substantially elongated flange portion (30) extending from the base first side (14), the flange portion (30) having a substantially T-shaped lateral cross-section, the flange portion (30) defining a flange first end edge (64) and a substantially opposed flange second end edge (56), the flange portion (30) being substantially longitudinally offset relatively to the base plate portion (12) such that the flange portion (30) is protruding from the base first end edge (20) substantially adjacent the flange first end edge (64); the base plate portion (12) and the flange portion (30) together defining a pair of substantially oppositely disposed channel recesses (65) facing substantially laterally outwardly relatively to the flange portion (12) for each receiving a portion of a respective one of the cladding tiles (40), the channel recesses (65) being each closed with a respective stop flange (66) extending substantially adjacent the flange first end edge (64), the stop flanges (66) being each substantially perpendicular to the base plate portion (30).

10 Claims, 8 Drawing Sheets

U.S. PATENT DOCUMENTS 6,279,286 B1 * 8/2001 Ichihashi ..... 52/489.1
6,289,646 B1 * 9/2001 Watanabe ..... 52/506.01
6,374,563 B1 4/2002 Erskine et al.
7,584,587 B2 * 9/2009 Ouellette et al. ..... 52/749.1
2002/0046536 A1 * 4/2002 Hotta ..... 52/698
2002/0050111 A1 * 5/2002 Hikai ..... 52/546
2004/0010998 A1 1/2004 Turco

* cited by examiner 13
18
14
26
22
10
32
65
60
56
24
12
58
48
54
30
42
28
34
46
20
44
66
64
16
84
82
32

SUPPORT BRACKET FOR ANCHORING OVERLAPPING CLADDING TILES TO A WALL STRUCTURE

FIELD OF THE INVENTION

The present invention relates generally to wall cladding assemblies and, more particularly, to a shaped support bracket for anchoring overlapping cladding tiles across the wall panels or frame members of a structure.

BACKGROUND

Anchoring elements for fastening cladding tiles to a support wall structure are known in the art. Such anchoring elements generally consist of a profiled member in the form of a plurality of anchoring brackets each provided with various protruding and/or laterally extending tabs or hooks. The anchoring brackets are generally nailed or screwed to the wall panels or frame members of a structure to be covered with cladding tiles. The cladding tiles may be inserted or clamped into tabs or hooks of the anchoring brackets gradually as the latter are fastened to the support wall structure, or only once all the anchoring brackets have been installed.

The anchoring bracket of the prior art is generally represented by an assembly of components screwed or welded together, or a single sheet of metal formed by a multi-step punch process, or is integrally molded as a one piece element using a conventional injection process. The preferred material or materials used to manufacture the bracket are generally rigid materials that is UV and corrosion resistant such as aluminum, stainless steel, ABS, PVC or the like.

Typical examples of the prior art are U.S. Pat. No. 4,516,373, to Osawa (1985), U.S. Pat. No. 2004/0010998A1, to Turco (2004), U.S. Pat. No. 5,390,457, to Sjolander (1995), U.S. Pat. No. 2,188,090, to Young (1989), and Japanese Pat. Nos. JP02115445A2, to Shimonohara (1990).

Although these prior art devices generally offer an anchoring means for fastening cladding tiles to a support wall structure, none satisfactorily accomplish this task in an efficient and economical way, particularly in the case of a support bracket for anchoring overlapping cladding tiles.

Against this background, there exist a need for a new and improved support bracket for anchoring overlapping cladding tiles to a support wall structure. It is a general object of the present invention to provide a new and improved support bracket for anchoring overlapping cladding tiles to a support wall structure.

SUMMARY OF THE INVENTION

A support bracket for anchoring cladding tiles to a support wall structure, the support bracket comprising: a substantially elongated base plate portion attachable to the support wall structure, the base plate portion defining a base first end edge and a substantially opposed base second end edge, the base plate portion also defining a base first side and a substantially opposed base second side; and a substantially elongated flange portion extending from the base first side, the flange portion having a substantially T-shaped transversal cross-section, the flange portion defining a flange first end edge and a substantially opposed flange second end edge, the flange portion being substantially longitudinally offset relatively to the base plate portion such that the flange portion is protruding from the base first end edge substantially adjacent the flange first end edge; the base plate portion and the flange portion together defining a pair of substantially oppositely disposed channel recesses facing substantially laterally outwardly relatively to the flange portion for each receiving a portion of a respective one of the cladding tiles, the channel recesses being each closed with a respective stop flange extending substantially adjacent the flange first end edge, the stop flanges being each substantially perpendicular to the base plate portion.

In some embodiments of the invention, the base plate portion is nailed or screwed to the wall panels or frame members of the support wall structure in a vertical orientation, with the horizontal lower edge of the base plate portion being slightly distanced from the wall structure due to an integrally formed spacer flange protruding along the lower rear edge of the base plate portion that is abutting against the support wall structure. Thus, the base plate has a slightly slanted configuration relative to the generally vertical structure of the support wall structure to be cladded.

Typically, the elongated flange portion is slightly longitudinally offset relative to the base plate portion such that a relatively small lower end portion of the flange portion is protruding downwardly from the bottom edge of the base plate portion. The lower distal end of the longitudinal recesses, on each side of the elongated flange, are closed with perpendicular stop flanges, whose role will be described hereinafter.

A general mode of installation of the support bracket is as follows: a first support bracket is nailed or screwed to, for example, a lower end corner of a wall to be covered. In a second operation, a first lateral edge of a cladding tile is sidewardly inserted into the channel recess that is facing towards the opposite side of the wall to be covered. In a third operation, another support bracket is positioned into place such that it is supporting the opposite, free standing side edge of the cladding tile. Thus, the cladding tile is firmly held between the oppositely disposed channel recesses, and have their lower distal end corner supported by the stop flanges at the lower ends of the recesses.

Hence, individual cladding tiles and support brackets may thus be alternatively fastened in place until the opposite side of the latter is reached, after which, the assembly of the next upper horizontal row of cladding tiles may be initiated. When installing the next upper row of alternating support bracket and cladding tile assemblies, the lower edge of the cladding tiles overlap the upper horizontal edges of the base plate portion of the support brackets in the underlying row, and abut on the top distal end of the flange portions of the latter. Thus, a firm and durable wall cladding assembly is achieved.

It is to be noted that all the support brackets on a same row may be installed in a suitably equidistantly spaced fashion, prior to inserting the cladding tiles into the elongated recesses of the brackets, in order to slidably insert the lower portion of their lateral edges through the top end of a pair of oppositely disposed channel recesses, between two previously anchored, adjacent support brackets.

Therefore, in another broad aspect, the invention provides a method for anchoring cladding tiles to a support wall structure using support brackets, each of the cladding tile defining substantially opposed tile first and second lateral edges and substantially opposed tile first and second end edges extending therebetween, the support brackets each including a substantially elongated base plate portion and a substantially elongated flange portion extending from the base plate portion, the flange portion having a substantially T-shaped lateral cross-section; the base plate portion and the flange portion together defining a pair of substantially oppositely disposed channel recesses facing laterally outwardly relative to the flange portion, the method comprising: attaching a first one of the support brackets to the support wall structure; inserting the tile first lateral edge of a first one of the cladding tiles into one of the channel recesses of the first one of the support brackets; and attaching a second one of the support bracket to the support wall structure such that the tile second lateral edge of the first one of the cladding tiles is inserted into one of the channel recesses of the second one of the support brackets.

The support bracket of the present inventions is particularly well suited to be used in cooperative relation with porcelain cladding tiles, but may as well be used with cladding tiles made of an other type of material such as, for examples, ceramic, stone, glass, PLEXIGLAS®, concrete board, high pressure and low pressure laminate, and CORIAN®, among others.

The present invention provides support bracket for anchoring overlapping cladding tiles to a support wall structure which greatly facilitates the task of anchoring the cladding tiles to a wall to be covered in an overlapping fashion, and which is moreover simple and economical to produce. The proposed support bracket is relatively easily installed by a single person in a few simple and ergonomic steps.

Other objects, advantages and features of the present invention will become more apparent upon reading of the following non-restrictive description of preferred embodiments thereof, given by way of example only with reference to the accompanying drawings.

DETAILED DESCRIPTION

Figures 2, 3:
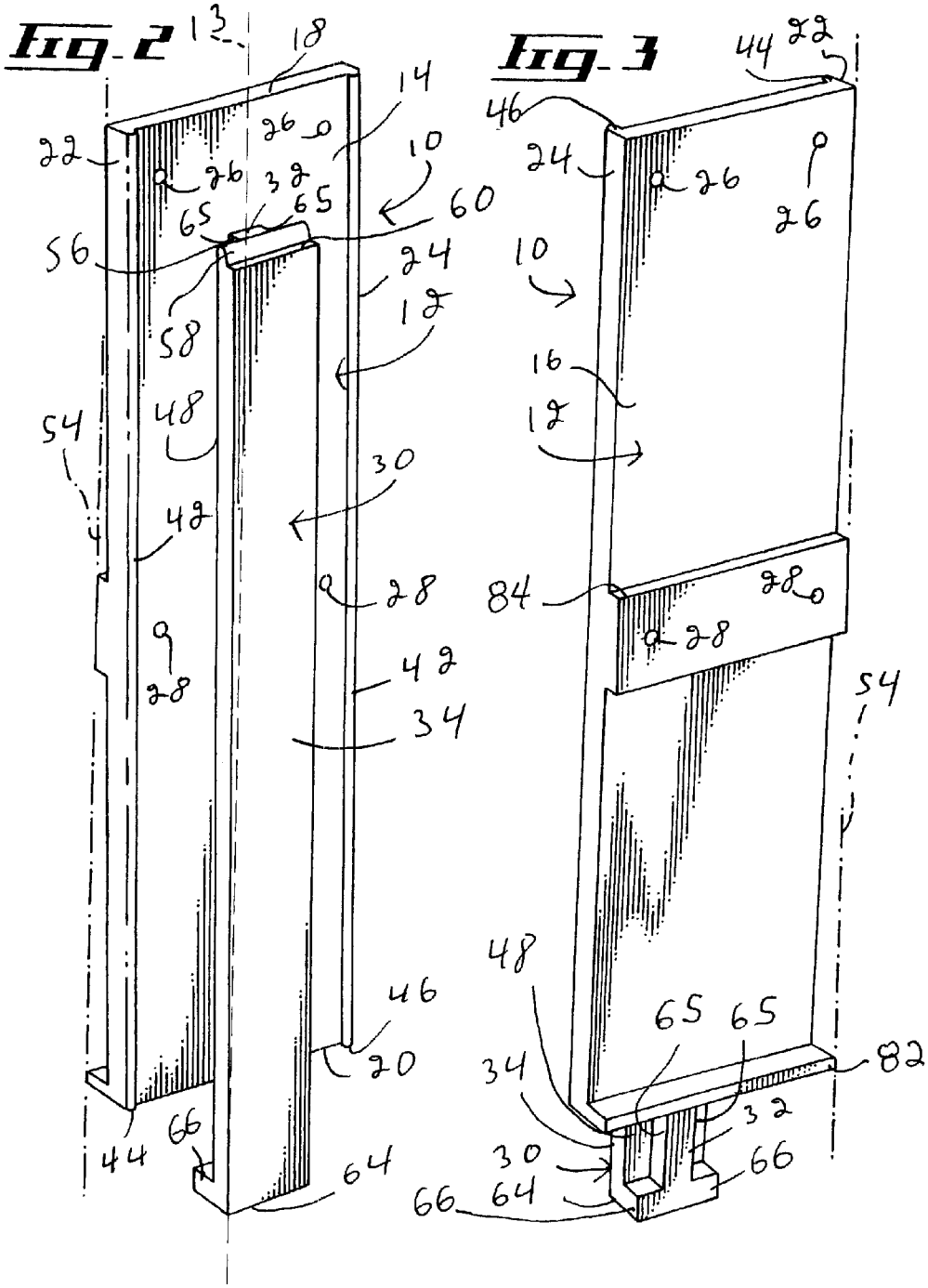
FIG. 2: is a top, front perspective view of the support bracket shown in FIG. 1.
FIG. 3: is a top, rear perspective view of the support bracket shown in FIGS. 1 to 3.

FIGS. 2 and 3 best show the various aspects of a preferred embodiment of the support bracket 10 according to the present invention. The support bracket 10 comprises a substantially elongated base plate portion 12 generally defines a base first side 14 and a substantially opposed base second side 16, a base second end edge 18 and a substantially opposed base first end edge 20 and opposite, and substantially longitudinally extending base side edges 22 and 24 each extending between the base second and first end edges 18 and 20. Typically, the base plate portion 12 is a substantially rectangular, but other shapes are within the scope of the invention. Also, when the support bracket 10 has been attached to a support wall structure 54, the base first side 14 faces outwardly relatively to the support wall structure 54, the base second side 16 faces towards the support wall structure 54, and the base second end edge 18 is located above the base first end edge 20.

In some embodiments of the invention, the base plate portion 12 is provided with at least one, and typically a pair of horizontally paired through holes 26 extending between the base first and second sides 14 and 16 substantially adjacent to the base second end edge 18. Also, in some embodiments, another pair of through holes 28 extends through the base plate portion 12 at a location intermediate the base first and second end edges 20 and 18, for example at a mid portion of the base plate portion 12. The through holes 26 and 28 are provided for nailing or screwing the support bracket 10 to wall panels or frame members of a structure.

Perpendicularly projecting from the base first side 14 of the base plate portion 12 there is an elongated, substantially longitudinally extending flange portion 30 having a substantially T-shaped cross-section generally defined by an elongated central web 32 portion and a perpendicular and substantially flat bar shaped upper portion 34. Typically, the base plate portion 12 defines a longitudinal central axis 13, the flange portion protruding from the base first side 14 substantially along the longitudinal central axis 13. The base plate portion 12 and the flange portion 30 together define a pair of substantially oppositely disposed channel recesses 65 facing substantially laterally outwardly relatively to the flange portion 30 for each receiving a portion of a respective one of the cladding tiles 40.

Figure 6:
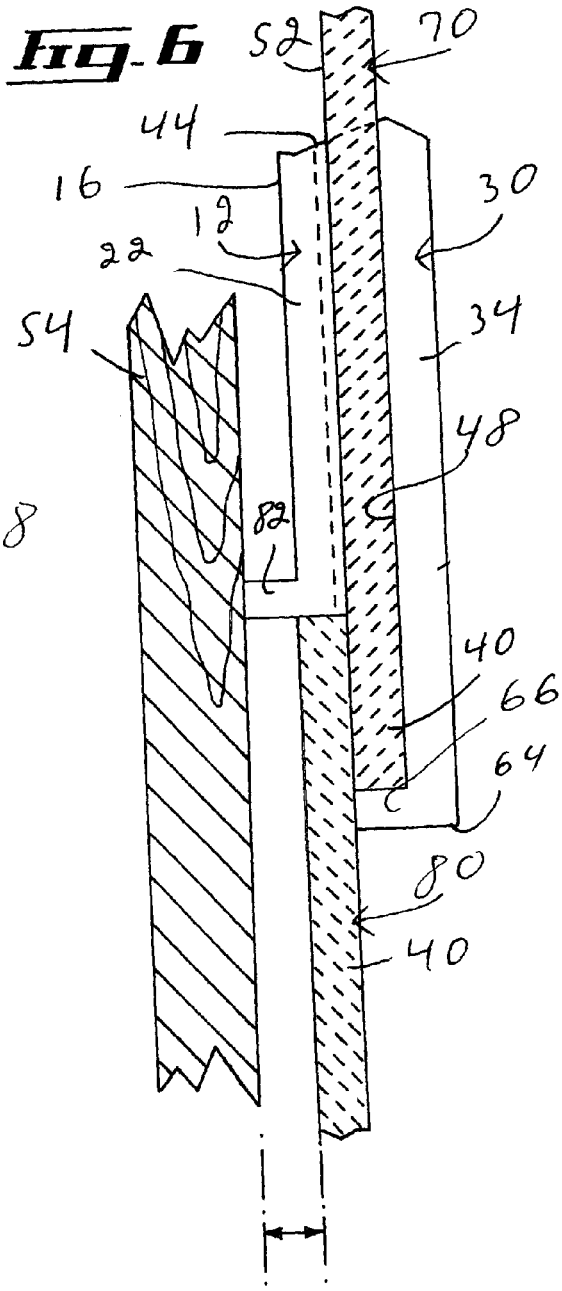
FIG. 6: is an enlarged, fragmented cross-sectional view taken along line VI-VI of FIG. 4, which shows a lower portion of the support bracket shown in FIGS. 1 to 3.

More specifically, the flat bar shaped upper portion 34 is sufficiently spaced apart from the surface of base first side 14 for allowing an edge thickness of a cladding tile 40 to be snugly slidably inserted between the apex 42 of a pair of oppositely disposed longitudinal edge ridges 44 and 46 each defined on the base first side 14 and extending respectively along the base side edges 22 and 24 of base plate portion 12, and an under side 48 of flat bar shaped upper portion 34, as best illustrated in FIG. 6. Thus, the flat bar shaped upper portion 34 of the flange portion 30 serves as a retaining means of the cladding tiles 40 against the base first side 14 of the base plate portion 12, as well as a vertical elongated member that aesthetically hides the junction of two laterally adjacent tiles.

Figure 5:
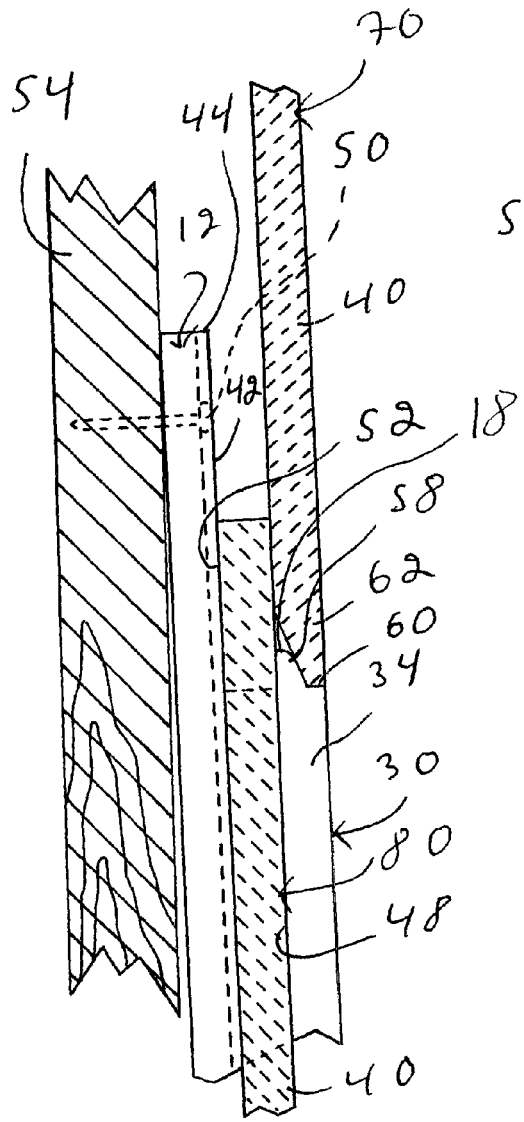
FIG. 5: is an enlarged, fragmented cross-sectional view taken along line V-V shown in FIG. 4, which shows an upper portion of the support bracket shown in FIGS. 1 to 3.

The oppositely disposed longitudinal edge ridges 44 and 46, have their apex 42 sufficiently raised from the surface of the base first side 14 to prevent slightly protruding nail or screw heads 50 from abutting on the rear side of cladding tiles 40 inserted on each sides of the flange portion 30 (as shown in FIG. 5). Longitudinal edge ridges 44 and 46, further prevent water that may infiltrate between the base plate portion 12 and the cladding tiles 40 from getting in contact with the rear side 52 of the latter, as well as preventing water from streaming around the base side edges 22 and 24 of the base plate portion 12 to reach the support wall structure 54.

As best illustrated in FIGS. 2 and 5, the flange portion 30 is terminated substantially adjacent to the flange second end edge 56, which is located at the top of the flange portion 30 when the support bracket 10 is mounted to the support wall structure 54, with an inner end portion 58 tapered inwardly towards base plate portion 12, and an outer abutting edge portion 60. The tapered inner end portion 58 and outer abutting edge portion 60 configuration is for supporting a compatibly shaped lower edge portion 62 of a cladding tile 40, as well as substantially preventing any water infiltration from reaching behind the flange portion 30.

As best illustrated in FIG. 3, the flange first end edge 64 of the flange portion 30 is provided with an inwardly oriented pair of stop flanges 66, whose purpose is to support a pair of lower end corners of laterally adjacent cladding tiles 40 juxtaposed to the central web 32 of the flange portion 30 (as best illustrated in 4).

Figure 4:
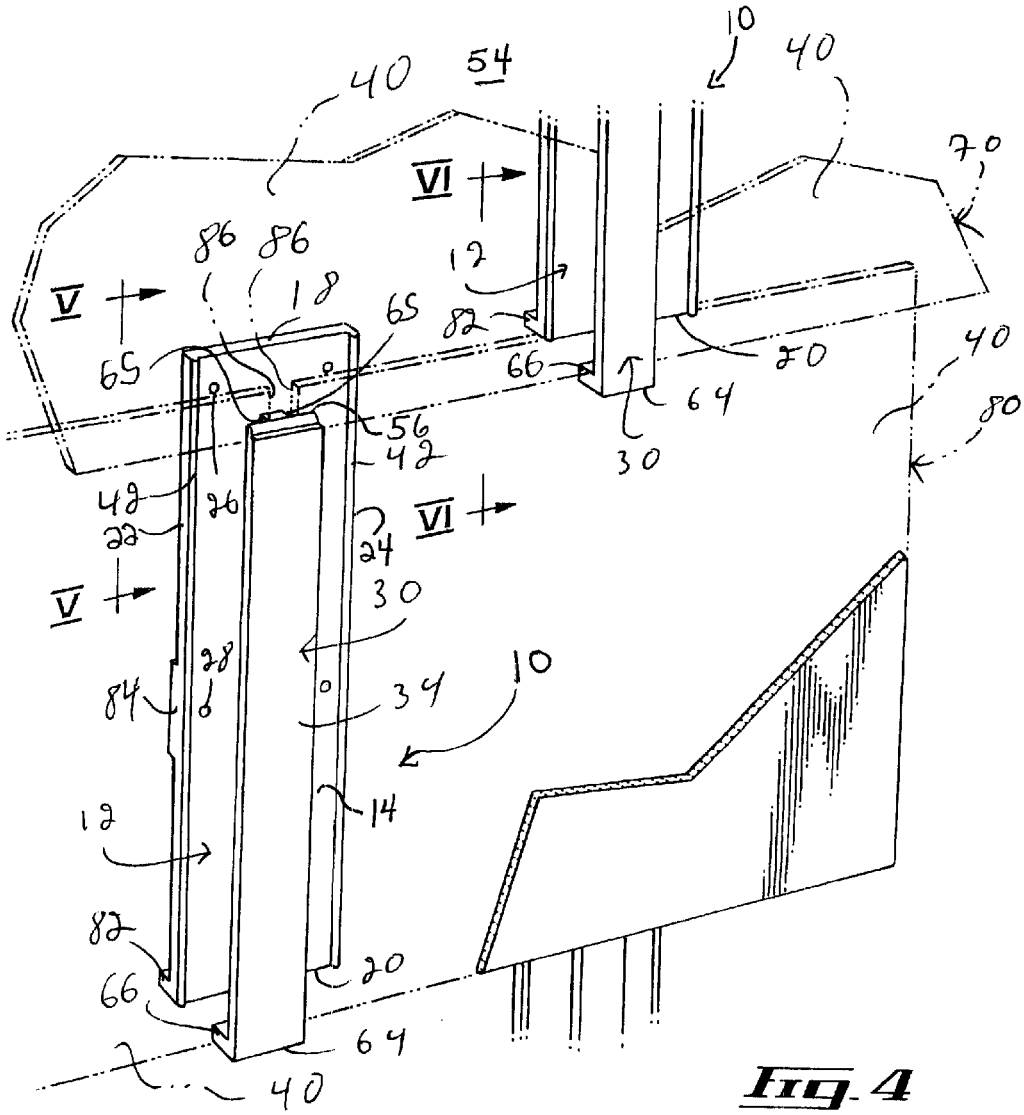
FIG. 4: is a partial fragmented view of the wall assembly shown in FIG. 1, showing an overlapping assembly of cladding tiles using the support bracket shown in FIGS. 1 to 3.

As best illustrated in FIGS. 2, 3 and 4, the flange portion 30 is substantially longitudinally offset relatively to the base plate portion 12 such that the flange portion 30 is protruding from the base first end edge 20 substantially adjacent the flange first end edge 64 and the flange second end edge 56 is substantially in register with the base plate portion 12 and in a spaced apart relationship relatively to the base second end edge 18.

In other words, when attached to the support wall structure 54, the flange portion 30 has its flange second end edge 56 positioned relatively lower than the base second end edge 18 of base plate portion 12 in order to support an overlapping lower edge portion 62 of the upper row 70 of cladding tiles 40. Conversely, the flange first end edge 64, equipped with the stop flanges 66, extends relatively lower than the base first end edge 20 of base plate portion 12 in order to support the overlapping lower edge portion 62 of the lower row 80 of cladding tiles 40 over the upper portion of an underlying row of cladding tiles (not shown).

The base second side 16 of base plate portion 12 has the base first end edge 20 provided with a perpendicularly projecting spacer flange 82 that is substantially extending the full width of the base plate portion 12. Spacer flange 82 establishes the overall angle of the base plate portion 12 relative to the support wall structure 54 of the wall cladding such that the base second side 16 of the base plate portion 12 is typically spaced from the support wall structure 54 a distance that is equivalent to, or more than, the typical thickness of a cladding tile 40.

Furthermore, the base second side 16 is provided with a laterally extending spacer ridge 84 whose position substantially coincides with the position of the paired through holes 28, and serves as a reinforcement spacer. Spacer ridge 84 is suitably shaped and sized to take into account the slightly slanted configuration of base plate portion 12 relative to the support wall structure 54 in order to prevent a longitudinal bending deformation of the support bracket 10 once the mid-portion of the latter is nailed or screwed to the support wall structure 54.

The support bracket 10 may be manufactured out of a rust proof metal or a UV proof polymeric resin, using a conventional injection molding process. Therefore, in some embodiments of the invention, the flange portion 30 and the base plate portion 12 are integrally formed as a single piece of material.

Now referring more specifically to FIGS. 1 and 4, in a manner readily apparent to one skilled in the art of exterior cladding, a general mode of installation of the support bracket 10 of the present invention is as follows: a first support bracket 10 is nailed or screwed to, for example, a lower end corner of the wall to be covered. In a second operation, a first side edge 86 of a cladding tile 40 is inserted, typically sidewardly, into the channel recess 65 along the side of the flange portion 30 that is facing inwardly towards the opposite side of the wall to be covered. In a third operation, a support bracket 10 is positioned and anchored into place such that it is supporting the opposite, free standing second side edge 86 of the cladding tile 40. Thus, the cladding tile 40 is firmly held between oppositely disposed channel recesses 65 formed in the support brackets 10, with their lower distal end corners supported by the stop flanges 66 at the lower ends of the channel recesses 65.

Hence, individual cladding tiles 40 and support brackets 10 may thus be alternatively fastened in place until the opposite side of the wall is reached, after which, the assembly of the next upper horizontal row of cladding tiles 40 may be initiated. When installing the next upper row of alternating support bracket and cladding tile assemblies, the equidistantly horizontally spaced support brackets 10 are nailed or screwed to the support wall structure such that each bracket is preferably anchored at a mid-position relative to two adjacent support brackets 10 in the underlying row. Furthermore, the lower horizontal edges 63 of the cladding tiles 40 of the upper row 70 are coincidentally abutting on the stop flanges 66 of their respective flange portions 30, as well as on the inner end portion 58 of the flange portions 30 of the support brackets 10 in the underlying row 80. Thus, a firm and durable wall cladding assembly is achieved.

It is to be noted that all the support brackets 10 on a same row may be installed in a suitably equidistantly spaced fashion, prior to inserting the cladding tiles 40 into the channel recesses 65 of the support brackets 10, in order to slidably insert the lower portion of their lateral edges through the top end of a pair of oppositely disposed elongated recesses, between two previously anchored, adjacent support brackets 10.

Figure 1:
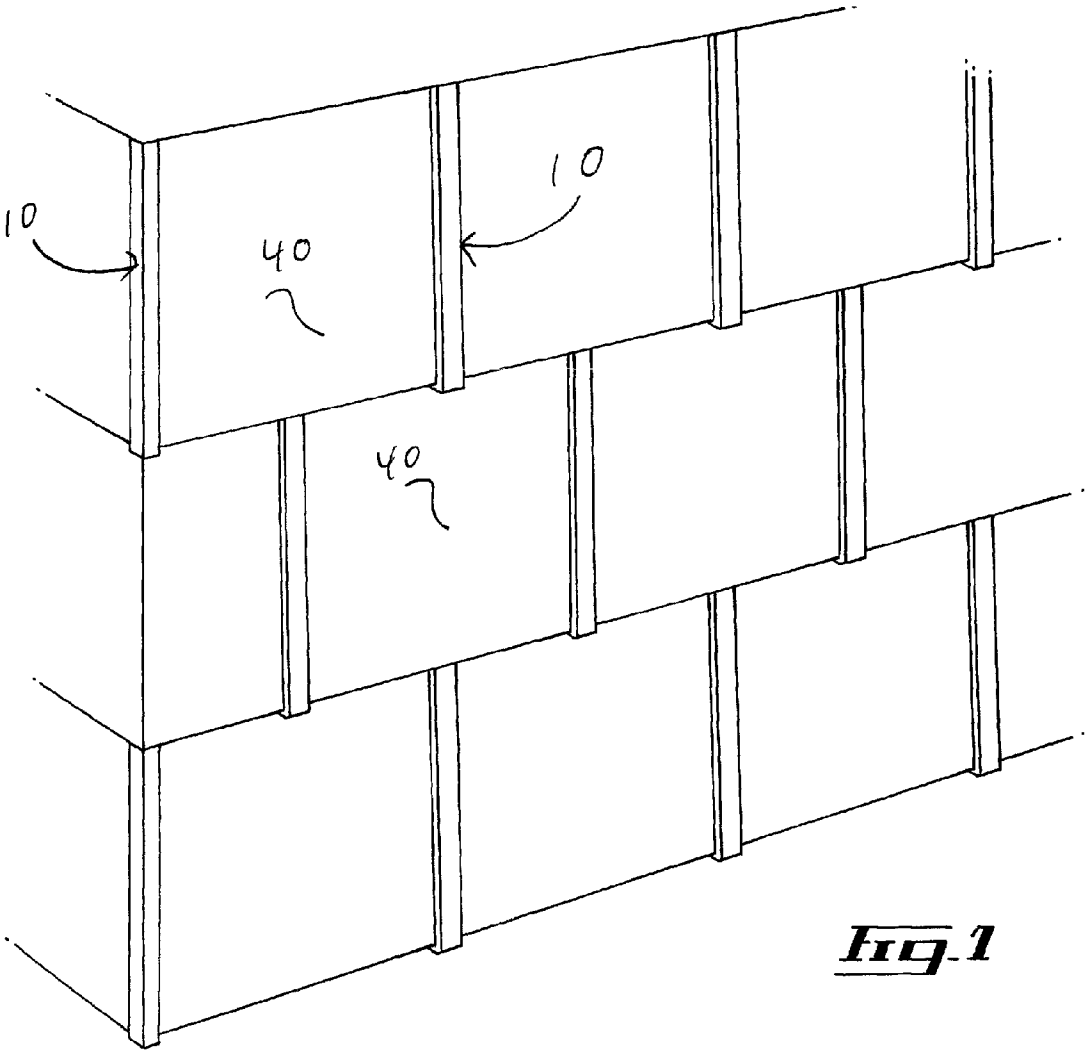
FIG. 1: is an environmental, top front perspective view of a wall cladding assembly using the support bracket according to an embodiment of the present invention.

For a firm and sturdy wall cladding assembly, such as illustrated in FIG. 1, the relative proportions and dimensions of the support bracket 10 are such that, for example, for a cladding tile 40 that is roughly 16 inches by 16 inches, the latter may have its lower edge portion 62 typically overlapping about 3 to 4 centimeters over the top portion of an underlying row of cladding tiles 40. Furthermore, as can be readily observed in FIGS. 5 and 6, the flat bar shaped upper portion 34, the central web 32, as well as the base plate portion 12, including the longitudinal edge ridges 44, 46, but excluding the perpendicularly projecting spacer flange 82, each preferably have the equivalent thickness of a cladding tile 40 used in the wall cladding assembly.

Figures 7, 8:
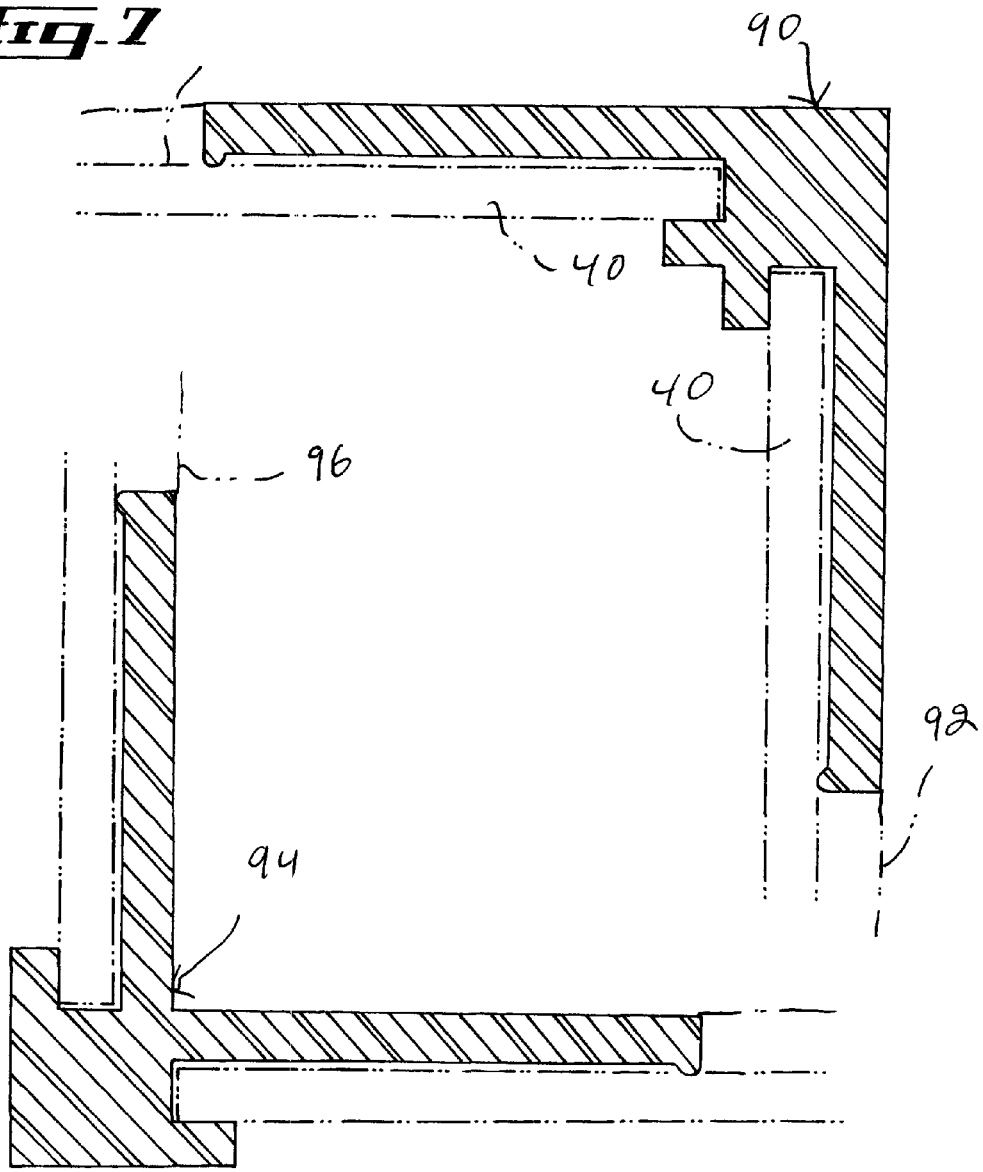
FIG. 7: is a top cross-sectional view of an alternate embodiment of the support bracket of the present invention, adapted for anchoring cladding tiles to an interior corner wall structure.
FIG. 8: is a top cross-sectional view of yet another alternate embodiment of the support bracket of the present invention, adapted for anchoring cladding tiles to an exterior corner wall structure.

FIG. 7 shows an alternate embodiment of a support bracket 90 which is adapted for anchoring cladding tiles 40 to an interior corner wall structure 92. The support bracket 90 of the present embodiment is essentially the same as the support bracket 10 of the first embodiment described above, except it is configured with a perpendicular inward bend along a central longitudinal axis of the bracket.

Conversely, FIG. 8 show yet another alternate embodiment of a support bracket 94, which is adapted for anchoring cladding tiles 40 to an exterior corner wall structure 96. Here again, the support bracket 94 of the present embodiment is essentially the same as the support bracket of the first embodiment described above, except it is configured with a perpendicular outward bend along a central longitudinal axis of the bracket. It is to be understood that the perpendicular bends of the embodiments 90 and 94 described above may as well be of any other suitable angular values, such as obtuse or acute, in order to install cladding on correspondingly angular corner wall structures.

Figure 9:
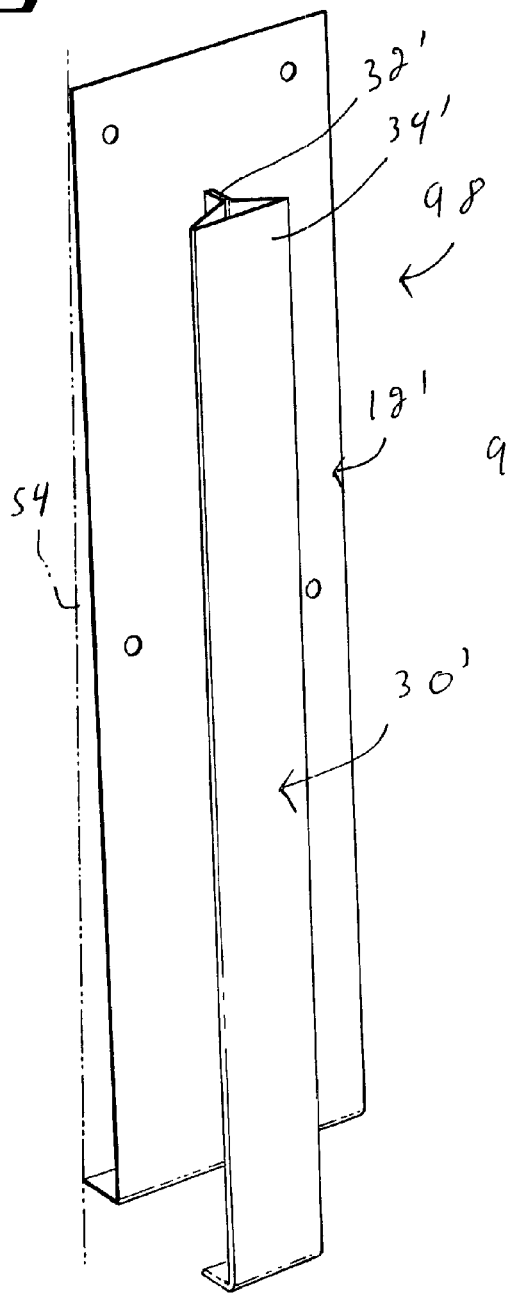
FIG. 9: is a top, front perspective view of a support bracket in accordance with an alternative embodiment of the present invention.
Figure 10:
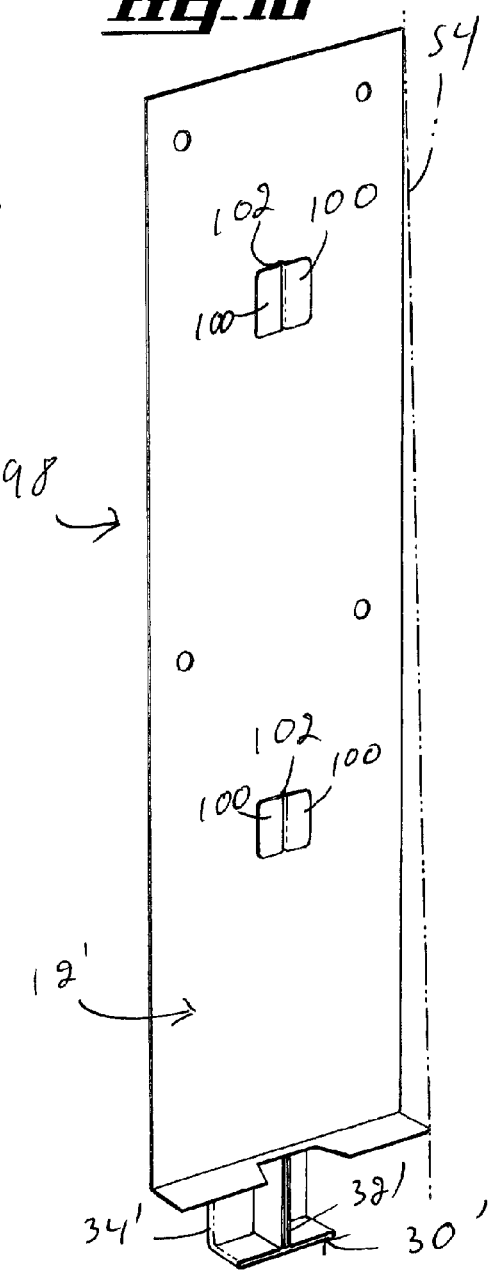
FIG. 10: is a top, rear perspective view of the support bracket shown in FIG. 9.

FIGS. 9 to 12 illustrate a support bracket 98 in accordance with an alternative embodiment of the present invention. The support bracket 98 is made out of folded sheet metal. With reference to FIGS. 9 and 10, the support bracket 98 includes an alternative base plate portion 12' consisting essentially of an L-shaped plate of metal in which substantially longitudinal flange mounting slits 102 extending therethrough (better seen in FIG. 10) are provided. The alternative flange portion 30' is made out of substantially rectangular piece of sheet metal that has been folded over itself, and in some embodiments spot-welded or otherwise secured to itself, to form an alternative substantially plate-shaped central web portion 32' and a substantially prism shaped upper portion 34' extending therefrom. Attachment tongues 100 extend from the plate-shaped central web portion 32' substantially opposite to the prism shaped upper portion 34'.

Figure 11:
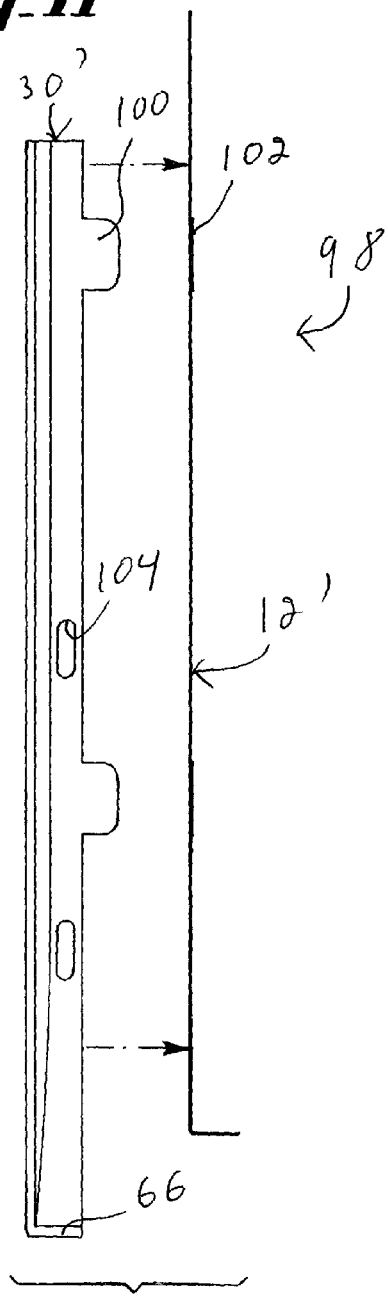
FIG. 11: is a side elevation view of the support bracket shown in FIGS. 9 and 10.
Figure 12:
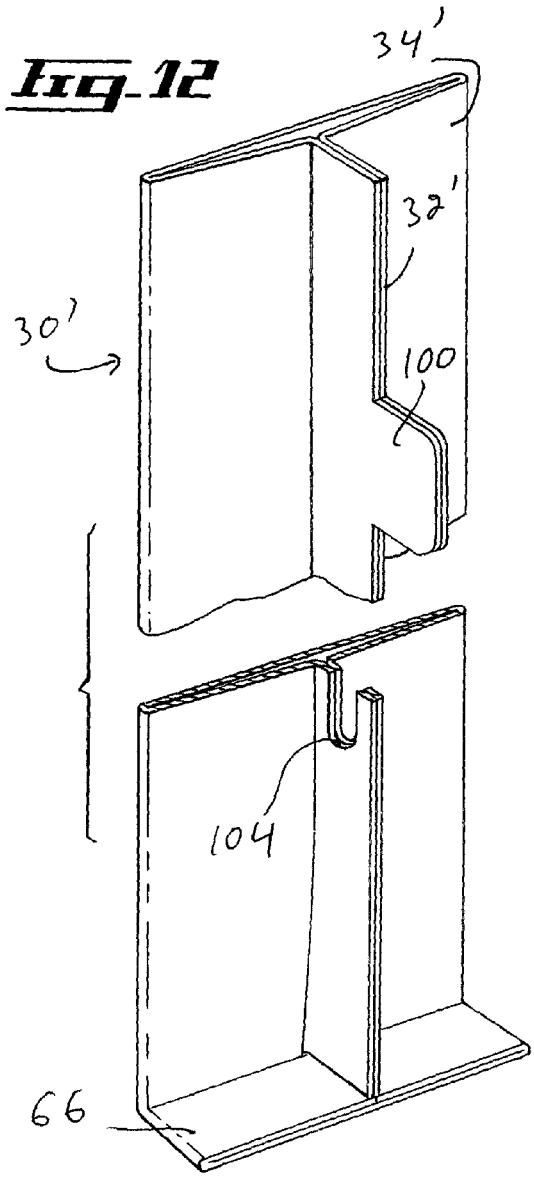
FIG. 12: is a top, rear perspective view with portions removed of a flange portion the support bracket shown in FIGS. 9 to 11.

The flange portion 30' is manufactured separately from the base portion 12' and is attached thereto by inserting the attachment tongues 100 into the flange mounting slits 102 and folding the attachment tongues 100 so that they extend substantially laterally outwardly, thereby immobilizing the base plate portion 12' between the attachment tongues 100 an the plate-shaped central web portion 32'. As seen in FIG. 11, in some embodiment of the invention, the plate-shaped central web portion 32' defines apertures 104 extending therethrough. The apertures 104 are usable, for example, for routing electrical wire therethrough.

Figure 13:
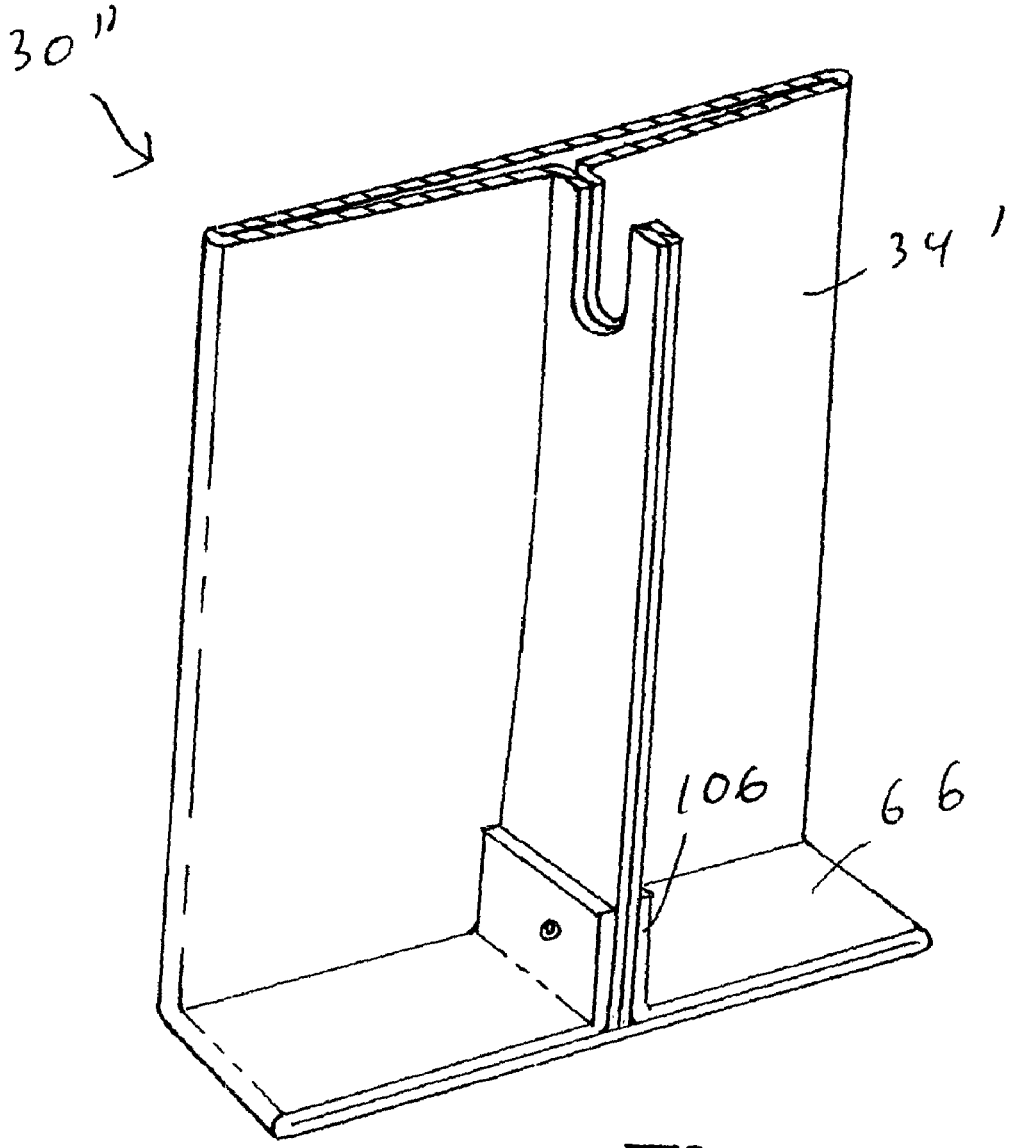
FIG. 13: is a top, rear partial perspective of an alternative flange portion usable in the support bracket shown in FIGS. 9 to 11.

FIG. 13 illustrates an alternative manner of forming the flange portion 30" in which the portion of a piece of sheet metal that has been folded to form the stop flange 66 extends over a lateral width large enough to define reinforcement tongues 106 that are foldable so as to extend parallel to the central web portion 32' and be attached thereto, for example using rivets or spot welding, among other possibilities.

Although the present invention has been described hereinabove by way of preferred embodiments thereof, it can be modified, without departing from the spirit and nature of the subject invention as defined in the appended claims.

What is claimed is:

1. A support bracket for anchoring cladding tiles to a support wall structure, said support bracket comprising:

a substantially elongated base plate portion attachable to said support wall structure, said base plate portion defining a base first end edge and a substantially opposed base second end edge, said base plate portion also defining a base first side and a substantially opposed base second side; and a substantially elongated flange portion extending from said base first side, said flange portion having a substantially T-shaped transversal cross-section, said flange portion defining a flange first end edge and a substantially opposed flange second end edge, said flange portion being substantially longitudinally offset relatively to said base plate portion such that said flange portion is protruding from said base first end edge substantially adjacent said flange first end edge;

said base plate portion and said flange portion together defining a pair of substantially oppositely disposed channel recesses facing substantially laterally outwardly relatively to said flange portion for each receiving a portion of a respective one of said cladding tiles, said channel recesses being each closed with a respective stop flange extending substantially adjacent said flange first end edge, said stop flanges being each substantially perpendicular to said base plate portion;

wherein said base second side is provided at a location intermediate said base first and second end edges with a substantially laterally extending spacer ridge, said support bracket further comprising at least one through holes extending through said base plate portion between said base first and second sides, said at least one through hole extending through said spacer ridge.

2. A support bracket as defined in claim 1, further comprising a spacer flange extending from said base second side substantially adjacent said base first end edge.

3. A support bracket as defined in claim 1, wherein said base plate portion defines a longitudinal central axis, said flange portion protruding from said base first side substantially along said longitudinal central axis.

4. A support bracket as defined in claim 1, wherein said flange portion and said base plate portion are integrally formed as a single piece of material.

5. A support bracket as defined in claim 1, wherein said base plate portion is substantially rectangular.

6. A support bracket as defined in claim 1, wherein said base plate portion defines two substantially opposed base side edges each extending between said base first and second end edges, said base plate portion also defining two oppositely disposed substantially longitudinal edge ridges each extending on said plate first side substantially along a respective one of said base side edges.

7. A support bracket as defined in claim 1, wherein said flange portion is terminated substantially adjacent to said flange second end edge with an inner end portion tapered substantially inwardly towards said base plate and an outer abutting edge portion.

8. A support bracket as defined in claim 7, wherein said flange second end edge is substantially in register with said base plate portion at a location intermediate said base first and second end edges.

9. A support bracket for anchoring cladding tiles to a support wall structure, said support bracket comprising:

a substantially elongated base plate portion attachable to said support wall structure, said base plate portion defining a base first end edge and a substantially opposed base second end edge, said base plate portion also defining a base first side and a substantially opposed base second side; and a substantially elongated flange portion extending from said base first side, said flange portion having a substantially T-shaped transversal cross-section, said flange portion defining a flange first end edge and a substantially opposed flange second end edge, said flange portion being substantially longitudinally offset relatively to said base plate portion such that said flange portion is protruding from said base first end edge substantially adjacent said flange first end edge;

said base plate portion and said flange portion together defining a pair of substantially oppositely disposed channel recesses facing substantially laterally outwardly relatively to said flange portion for each receiving a portion of a respective one of said cladding tiles, said channel recesses being each closed with a respective stop flange extending substantially adjacent said flange first end edge, said stop flanges being each substantially perpendicular to said base plate portion;

wherein said flange portion is terminated substantially adjacent to said flange second end edge with an inner end portion tapered substantially inwardly towards said base plate and an outer abutting edge portion.

10. A support bracket as defined in claim 9, wherein said flange second end edge is substantially in register with said base plate portion at a location intermediate said base first and second end edges.

* * * * *